US006581504B2

(12) United States Patent
Caron

(10) Patent No.: US 6,581,504 B2
(45) Date of Patent: Jun. 24, 2003

(54) PASSIVE ARMOR FOR PROTECTION AGAINST SHAPED CHARGES

(76) Inventor: Paul Caron, 2426 Quatre-Bourgeois, Apt. 11, Ste-Foy, Québec (CA), G1P 4P3

( * ) Notice: Subject to any disclaimer, the term of this patent is extended or adjusted under 35 U.S.C. 154(b) by 0 days.

(21) Appl. No.: 10/017,363

(22) Filed: Dec. 14, 2001

(65) Prior Publication Data

US 2002/0092415 A1 Jul. 18, 2002

(30) Foreign Application Priority Data

Dec. 15, 2000 (CA) ..... 2328285

(51) Int. Cl.[7] ..... F41H 5/02
(52) U.S. Cl. ..... 89/36.02
(58) Field of Search ..... 89/36.02, 36.01, 89/36.08

(56) References Cited

U.S. PATENT DOCUMENTS

| | | | | | |
|---|---|---|---|---|---|
| 952,877 | A | * | 3/1910 | Cowper-Coles | 109/81 |
| 1,463,498 | A | * | 7/1923 | Burgess | 109/80 |
| 2,985,411 | A | * | 5/1961 | Madden, Jr. | 244/123 |
| 3,031,046 | A | * | 4/1962 | Hoadley | 188/268 |
| 3,135,044 | A | * | 6/1964 | Mote, Jr. et al. | 29/423 |
| 3,324,768 | A | * | 6/1967 | Eichelberger | 109/80 |
| 3,421,200 | A | * | 1/1969 | Gregory | 228/182 |
| 3,427,139 | A | * | 2/1969 | Gregory | 149/2 |
| 3,431,818 | A | * | 3/1969 | King | 109/80 |
| 3,523,057 | A | * | 8/1970 | Buck | 109/24 |
| 3,705,558 | A | * | 12/1972 | McDougal et al. | 109/84 |
| 4,179,979 | A | * | 12/1979 | Cook et al. | 109/49.5 |
| 4,504,565 | A | | 3/1985 | Baldvins et al. | 430/138 |
| 4,665,794 | A | * | 5/1987 | Gerber et al. | 89/36.2 |
| 4,665,795 | A | * | 5/1987 | Carbonneau et al. | 356/139.08 |
| 4,869,152 | A | | 9/1989 | Marlow et al. | 89/36.17 |
| 5,110,661 | A | * | 5/1992 | Groves | 2/2.5 |
| 5,175,133 | A | | 12/1992 | Smith et al. | 501/127 |
| 5,361,678 | A | * | 11/1994 | Roopchand et al. | 109/84 |
| 5,364,679 | A | * | 11/1994 | Groves | 109/49.5 |
| 5,395,686 | A | | 3/1995 | Marshall et al. | 428/283 |
| 5,402,704 | A | | 4/1995 | Donovan | 89/36.03 |
| 5,492,870 | A | | 2/1996 | Wilcox et al. | 501/80 |
| 5,637,824 | A | | 6/1997 | Benyami | 89/36.17 |
| 5,738,925 | A | * | 4/1998 | Chaput | 2/2.5 |
| 5,866,839 | A | * | 2/1999 | Ohayon | 89/36.02 |
| 5,935,699 | A | | 8/1999 | Barber | 428/325 |
| 6,112,635 | A | * | 9/2000 | Cohen | 428/911 |
| 6,258,338 | B1 | | 7/2001 | Gray | 424/1.29 |
| 6,311,605 | B1 | * | 11/2001 | Kellner et al. | 89/36.02 |

FOREIGN PATENT DOCUMENTS

| | | | |
|---|---|---|---|
| EP | 0959321 | 11/1999 | F41H/5/04 |
| GB | 746371 | 3/1956 | |
| WO | 99/64811 | 12/1999 | F41H/5/02 |

* cited by examiner

*Primary Examiner*—Charles T. Jordan
*Assistant Examiner*—Jordan M Lofdahl
(74) *Attorney, Agent, or Firm*—Darby & Darby

(57) ABSTRACT

A passive armour for protection against shaped charges, comprising a rigid enclosure or body filled with hollow microspheres made of a material having a density greater than 7 g/cm$^3$ and hardness at least equal to Rockwell A 83.4(equal to 64 RC and 800 Vickers). The armour can be made integral to a basic armour element or it could be an add-on to a basic armour plate. It can be used for the protection of an enclosure selected from the group consisting of land vehicles such as battle tanks, armoured personnel carriers and armoured fighting vehicles; static structures and aircrafts.

23 Claims, 4 Drawing Sheets

PASSIVE ARMOR FOR PROTECTION AGAINST SHAPED CHARGES

FIELD OF THE INVENTION

This invention relates generally to the field of armour and armoured vehicles. More specifically, it concerns a passive armour for protection against shaped charges

BACKGROUND OF THE INVENTION

In the old days, the armours were normally made of a homogeneous metal plate made of steel or other high strength alloyed metal. The effectiveness of these plates depends on their thickness. Theoretically, these plates could defeat most forms of attack provided that the plate is thick enough. However, in practice the thickness is limited by considerations of cost and weight. The mobility of an armoured vehicle is an important aspect of performance, which is reduced by excessive weight.

An armour plate with an improved resistance to impact has been developed by the militaries. Such armour plate is made of steel with a high content of residual austenite. The presence of residual austenite allows a release of the mechanical stresses when the plate is under tension. The impact of a projectile striking on the plate put the same under tension. This tension leads to a decrease of the intrinsic compression stresses, which were preventing the final transformation of the residual austenite present in the microstructure, and thus induces the transformation of the residual austenite. This transformation, which is accompanied by a volume increase of approximately 4%, makes it possible to delay and even to prevent the material from reaching the maximum stresses sustainable before the point of rupture. This effect occurs when the projectiles have a velocity that corresponds to the velocity of a typical ballistic projectile. However, such armour plate has proved to be inefficient when the projectile travels at very high speed typical of shaped charges.

Shaped charges are weapons also known as hollow charge munitions, warheads with shaped-charged munitions, kinetic energy projectiles or lined cavity charges. A shaped charge can pierce a thick armour plate having a thickness as large as 19 inches (48.26 cm). A shaped charge fired on an armoured vehicle can pierce the armour of the same and explode within the vehicle thereby destroying the protected objects or people within the vehicle.

U.S. Pat. No. 6,311,605 gives a description of a shaped charge and of the working of such weapon. FIG. 1 which substantially corresponds to FIG. 1 of U.S. Pat. No. 6,311,605 shows a shaped charge in the form of a bomblet 1 at the point in time of striking against the surface 100 of a target protected with an armour. The bomblet 1 consists essentially of a housing 2, which is filled with an explosive 3 in such a manner that this explosive 3 surrounds a downwardly opening insert 4, which is constituted of a material, such as copper. The explosive 3 that is through-detonated by means of a fuse 6 presses the insert 4 together at a high rate of speed so that, from the tip region of the insert 4, there is formed a hollow charge-jet or a jet 5. The insert 4 is thus deformed by means of the detonation of the explosive 3 into the jet 5, which moves under a continual stretching effect towards the surface 100 and penetrates into the latter. The peak velocities of the particles, which form the jet 5, lie hereby between 5 and 10 kilometers per second (km/sec), whereas the diameter of the formed jet 5 lies within the millimeter range. At a complete precision, in homogeneous steel armour there are attained penetrating depths, which lie between 4 to 8 times the largest insert diameter. The mechanical impact detonation is effected, as a rule, in that a detonating needle 7 due to its inertia, upon striking against the object moves in a passageway 8 towards the fuse 6, and pierces the latter, as a result of which there is detonated the bomblet 1. The fuse 6 thereby brings the explosive 3 to detonation.

The power capability of the bomblet 1 depends essentially upon the stretching or expansion of the jet 5. This is achieved in that the originally quasi-homogeneous jet at the point in time of its formation is stretched and thereby is caused to be particularized. A depth effect is then obtained from the addition of the individual power of the individual particle forming the jet 5, which must penetrate behind each other in an absolutely precise manner. The stretching of the jet 5 takes place continuously, whereby the distance between the particles from the tip in the direction of the bomblet 1 continually reduces. For a desired penetrating power, it is necessary to provide a specific stretching path 9, which is generally designated as a stand-off. The stand-off 9 is formed by the distance of the lower conical boundary of the insert 4 to the surface 10. It is known that the optimal piercing speed of the jet is obtained at a stand-off of approximately three times the diameter of the insert 4. This phenomenon is known in the US as the Munroe effect whereas, in Germany, it is known as the Neuman effect. FIG. 2*b* shows the path of the jet within the thickness of an armour. It is now generally recognised by the scientific community that the jet of metal in fusion that propagates within the thickness of the armour is subject to an erosion effect whereby the jet gradually wears away by abrasion against the surfaces (102) defining the hole made by the same in the armour. This erosion effect is believed to be one of the major causes explaining the stop of the jet. The capacity of a shaped charge to pierce thick armour walls results from the extremely high speed (several thousand meters per second) obtained by the jet.

Many attempts have been made in the prior art to reduce the devastating piercing effect of the shaped charges. Among these attempts, there are the reactive armours provided with explosives. These reactive armours consist of a layer of metal backed by a layer of explosive material. The explosive is detonated by the attack and the metal layer is thus projected into or across the path of the attacking device so as to destroy or degrade its attack mechanism. Examples of such reactive armours are given in U.S. Pat. No. 4,869,152 and U.S. Pat. No. 5,637,824. One important drawback with such reactive armours is the collateral damages often caused to the people or army troops surrounding the armoured vehicle under attack. In such case, the shaped charge that explodes at the outer surface of the armour does not cause damage to the people or objects within the vehicle but to the people outside the same.

Also known in the prior art are the armours adapted to deviate the jet from its course before it strikes against the target surface. An example of such armour is given in U.S. Pat. No. 5,402,704, which discloses an armour system comprising a plurality of inclined plates positioned with respect to an incoming projectile in front of the wall target. Another example is given in U.S. Pat. No. 6,311,605 wherein an arrangement for protection against shaped charges is disclosed. Such arrangement comprises disruptive bodies provided on the surface of the target object. The height, shape and arrangement of the disruptive bodies are dimensioned such that at least one such body, for the disruption of the jet formation of the shaped charge, can penetrate into an internal region of a hollow charge insert or into the so-called stand-off region of the shaped charge. The principle of the arrangement disclosed in U.S. Pat. No. 6,311,605 is predicated on that the formation of a symmetrical jet of a bomblet can be prevented, and thereby the power thereof can be quite significantly reduced.

The so important piercing capacity of a shaped charge on a prior art armour made of steel or other alloyed metal can be explained by the fact that the velocity of the jet at the point of impact on the surface of the armour is such that no plastic deformation of the target material can occur. The material is thus subject to a brittle fracture limited only by the density and the hardness of the target material. Once the crack has been initiated at the surface of the armour, its propagation through the armour is flashing. FIG. 2 illustrates the piercing effect (11) of a shaped charge (1) (FIG. 2*b*) compared with the effect of a traditional ballistic projectile (13) (FIG. 2*a*). Since no mechanical properties of the material helps limiting the penetration capacity of the jet, apart from the density and a marginal effect of the hardness of the material, it is possible to pierce thick steel plates of 19 inches (48.26 cm) thickness with a relatively small charge.

The following formula of Christman-Gehring modified by Doyle and Buchholz (1973) give the penetration distance of a jet formed by a shaped charge:

$$P=(L-D)(\rho_p/\rho_t)^{1/2}+0.13(\rho_p/\rho_t)^{1/3}(E_1/B_{max})^{1/3}$$

wherein

P is the penetration depth

L is the length of the projectile

D is the diameter of the projectile $\rho_p$ is the density of the projectile $\rho_t$ is the density of the target $E_1$ is the kinetic energy remaining after the jet has penetrated beyond the surface of the target; and $B_{max}$ is the hardness of the target.

This formula has two parts, the first one corresponding to the primary penetration and the second one corresponding to the secondary penetration also called inertial penetration. Overall, the only variables limiting the depth of penetration are the hardness and the density. In view of the actual theory around shaped charges and the weight factor of the vehicle to be armoured, it is very difficult to obtain an armour that will satisfactorily protect the vehicle.

A lot of developments have been made to provide an armour for protection against shaped charges, however there is still a need for a passive armour which will be efficacious as well as relatively light as compared to prior art attempts so as to not overload the protected object.

SUMMARY OF THE INVENTION

An object of the present invention is to provide a passive armour that satisfies the above-mentioned need.

In accordance with the present invention, this object is achieved with a passive armour for protection against shaped charges, the passive armour comprising a rigid enclosure filled with hollow microspheres made of a material having a density greater than 7 g/cm3 and a hardness at least equal to 800 Vickers (64 RC or Rockwell A 83.4), more preferably the hardness ranges from 2400 Vickers to 3200 Vickers.

The improved capacity of a passive armour according to the invention relies on the fact that the hollow microspheres give to the overall structure a global capacity to plastic deformation, the plastic deformation concept being understood herein to be the deformation occurring in a material prior to its final rupture and to the energy absorbed by such deformation. The microspheres also provide to the structure a multiplicity of surfaces and thus a multiplicity of crack's initiation sites. In other words, the jet to pierce the armour has to initiate a multiplicity of cracks at the surface of these so many microspheres, which are made of a very hard and dense material. And thanks to the fact that those microspheres are hollow, the cracks thus formed cannot propagate within the microsphere. The jet is thus always facing new surfaces of a hard and dense material, which material requires a very important quantity of energy to initiate a crack therein. Because of these microspheres, most of the initial energy of the jet is used to initiate a multiplicity of cracks at the surface of those microspheres and not to pierce the armour. The energy generated by the high velocity shaped charge thus loses almost all of its devastating effect.

The erosion of the jet against the surfaces of the fragmented microspheres also greatly helps limiting the capacity of the jet to penetrate deep within the armour. This could be explained by the fact that those surfaces which are obtained from the brittle fracture of a very hard material are in the form of sharp edges providing efficacious abrasion surfaces which gradually slow down and stop the propagation of the jet.

In accordance with a preferred embodiment, the enclosure is preferably in the form of a plate and the microspheres are preferably embedded in a matrix. In such a case, the matrix is preferably made of a material selected from the group consisting of an organic material and a metallic material. More preferably, the metallic materiel is selected from the group consisting of miltary steels, high-strength low-alloy steels, nitinol, tool steels and martensitic steels with residual austenite content.

The hollow microspheres are preferably carbide microspheres, the carbide being more preferably selected from the group consisting of WC, TiC, NbC, SiC and BC.

Also preferably, the microspheres occupy in volume at least 20% of the total volume of the enclosure. Most preferably, the microspheres occupy at least one third of the enclosure.

In accordance with another aspect, the present invention provides a passive armour for protection against shaped charges, the passive armour comprising:

a body made a plurality of hollow microspheres of tungsten carbide embedded in a metallic matrix, the microspheres occupying in volume at least 20% of the total volume of the body and having a diameter ranging from 10 $\mu$m to 500 $\mu$m. In accordance with a further aspect, the present invention proposes the use of a passive armour as defined above for the protection of an enclosure selected from the group consisting of land vehicles, static structures and aircrafts.

A passive armour according to the invention may be made integral to a basic armour element or it could be used as an add-on to a basic armour plate.

BRIEF DESCRIPTION OF THE DRAWINGS

These and other objects and advantages of the invention will become apparent upon reading the detailed description and upon referring to the drawings in which.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF PREFERRED EMBODIMENTS

Figure 3:
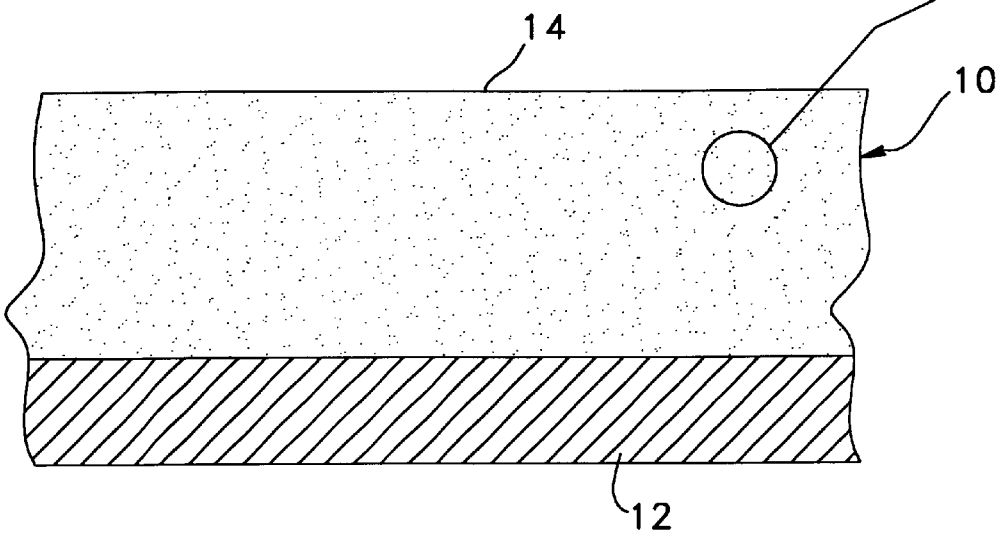
FIG. 3 is a fragmentary section across a passive armour according to a first preferred embodiment of the invention.

Referring to FIG. 3, a passive armour (10) according to a preferred embodiment of the invention is shown as an integral part of a basis armour plate (12). The passive armour (10) comprises a rigid enclosure (14) filled with hollow microspheres (16) made of a material having a density at least equal to 7 g/cm$^3$ and a hardness at least equal to 800 Vickers (equal to 64 RC and Rockwell A 83.4).

Figure 1:
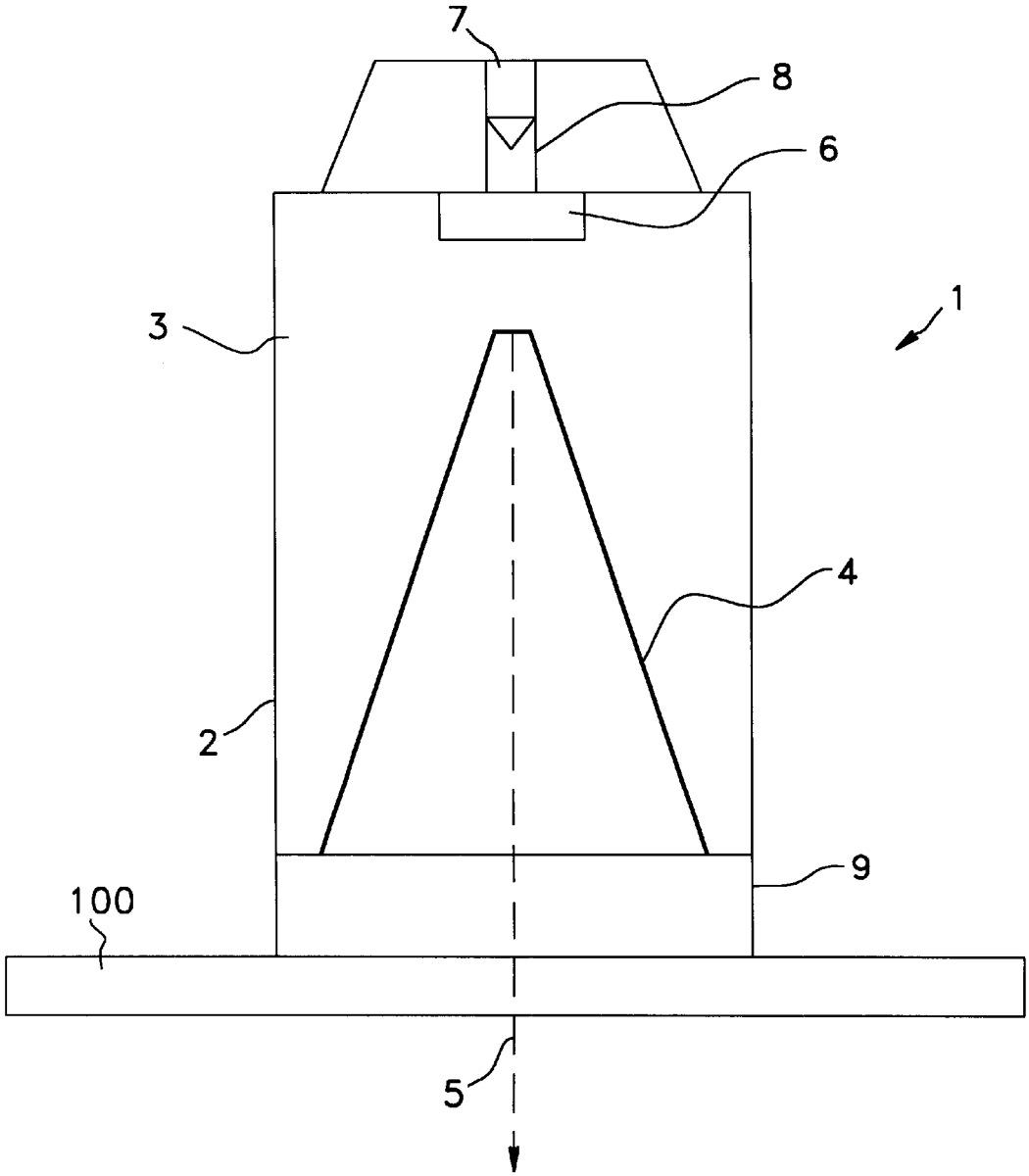
FIG. 1 is a schematic side view of a shaped charge at the point in time of striking against the surface of a target protected with an armour.
Figure 2B:
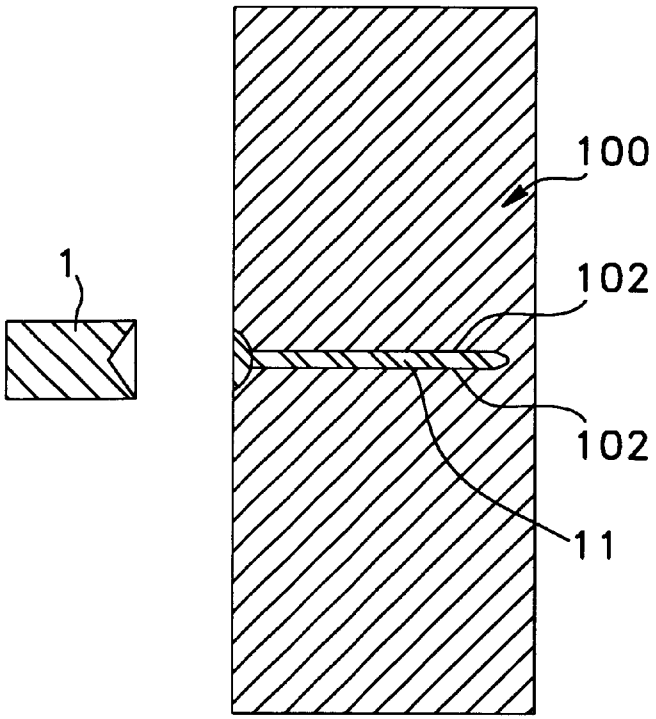
FIG. 2 illustrates the piercing effect of a shaped charge (FIG. 2*b*) compared with the effect of a traditional ballistic projectile (FIG. 2*a*)
Figure 2A:
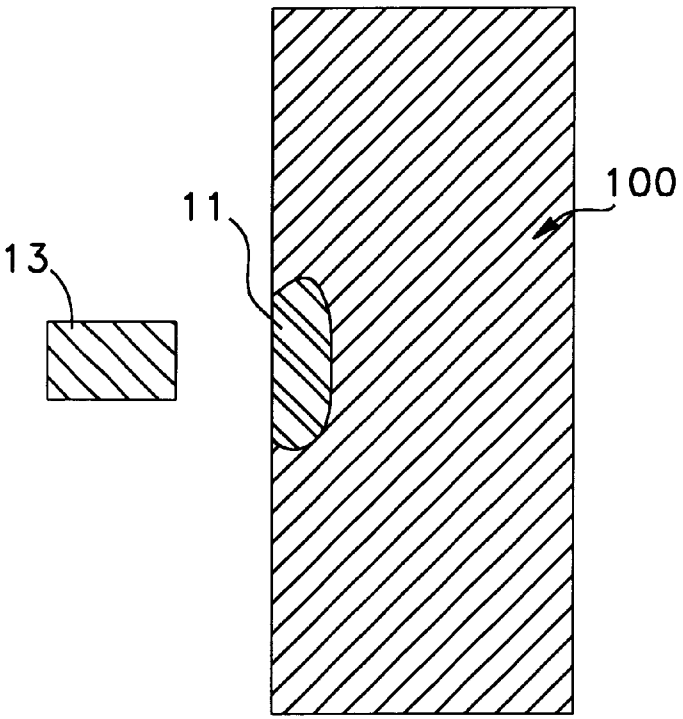
Figure 4:
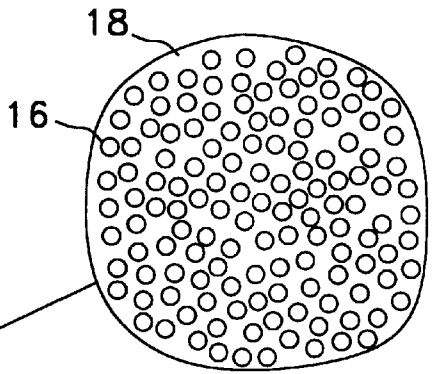
FIG. 4 is an enlarged view of the encircled portion in FIG. 3.

The purpose of using this rigid enclosure (14) is to prevent the microspheres (16) from moving one with respect to the others. Therefore, in a preferred embodiment not illustrated, the enclosure (14) could be made in the form of a box with rigid walls made for example of high strength steel. However, the use of a rigid enclosure, as in FIG. 3, is preferred. In such a case, the rigid enclosure (14) is in the form of a plate and it comprises a matrix (18) in which the miscrospheres are embedded, as best shown in FIG. 4.

A passive armour (10) according to the invention can be integral to a basic armour element, as in FIG. 3, or it could be used as an add-on to a basic armour plate.

The matrix (18) is preferably made of a material selected from the group consisting of an organic material and a metallic material. More preferably, it is a metallic material selected from the group consisting of military steels, high-strength low-alloy steels, nitinol, tool steels and martensitic steels with residual austenite content. Examples of organic material that can be used are cement and composite materials with fibers such as glass fibers and carbon fibers.

In order to obtain the expected results, the hollow microspheres (16) are made of a very hard and dense material. Any material having a density and hardness at least equal to the density and hardness of a quenched steel, that is approximately 7 g/cm$^3$ for the density and approximately 800 Vickers for the hardness, is suitable. Preferably, the density of the microspheres (16) is greater than 10 g/cm$^3$ and the hardness is preferably ranging from 2400 Vickers to 3200 Vickers. The more preferable material for making the microspheres (16) is a carbide selected from the group consisting of WC, TiC, NbC, SiC and BC. Most preferably, the microspheres (16) are made of tungsten carbide (WC).

The hollow microspheres (16) preferably have a diameter ranging from 10 $\mu$m to 500 $\mu$m and occupy in volume at least 20% of the total volume of the enclosure (14).

Most preferably, the passive armour (10) according to the invention is a body made of a metallic matrix (18) embedding a plurality of hollow microspheres (16) of tungsten carbide, the microspheres (16) occupying in volume at least 20% of the total volume of the body and having a diameter ranging from 10 $\mu$m to 500 $\mu$m.

Figure 5:
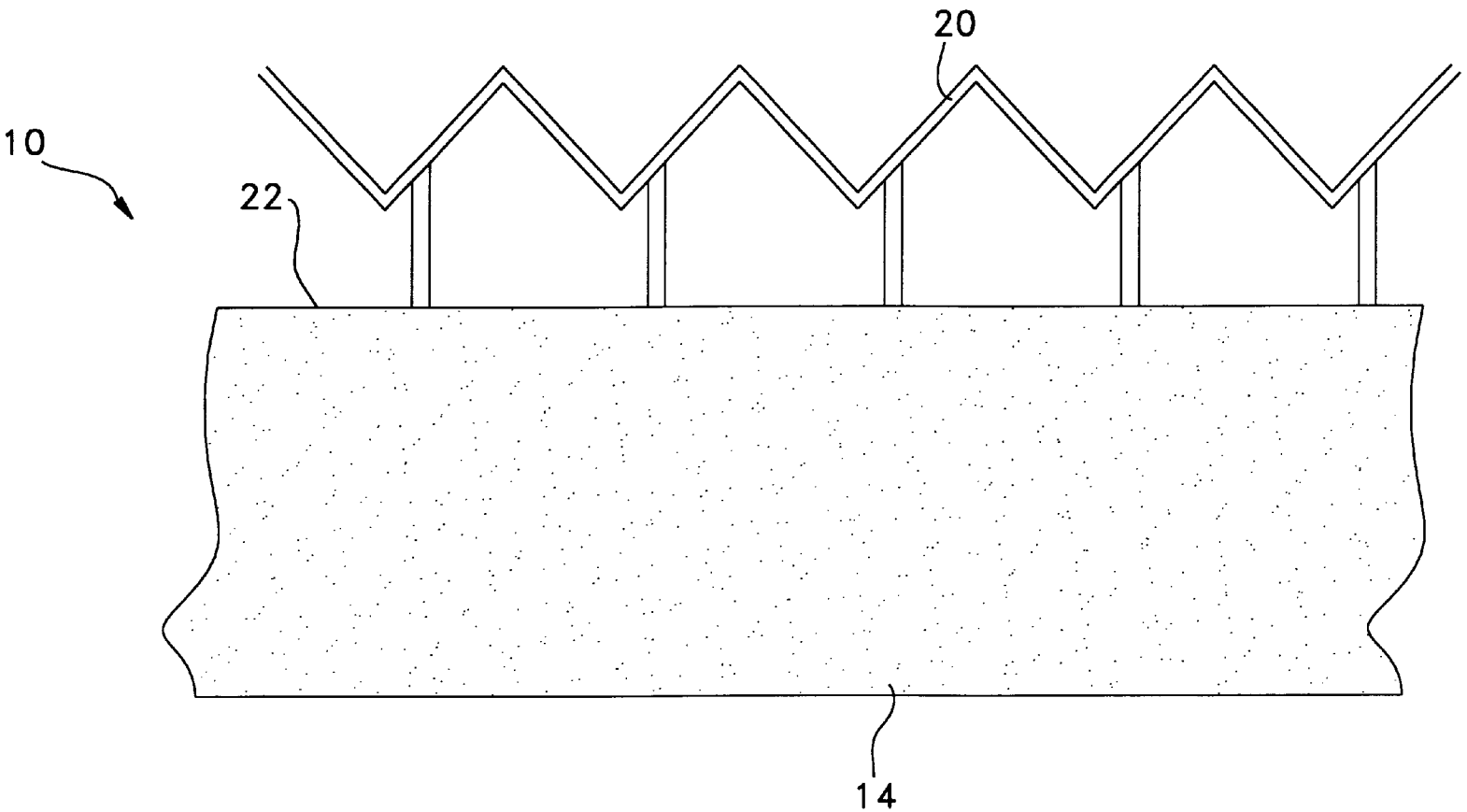
FIG. 5 is a schematic fragmentary section across a passive armour according to a second preferred embodiment of the invention.

Referring now to FIG. 5, a passive armour (10) according to a second preferred embodiment of the invention preferably further comprises triggering means for triggering an explosion of a shaped charge approaching the passive armour (10). The triggering means preferably comprise means for deviating a jet from the shaped charge. More preferably, the triggering means comprise a series of plates (20) mounted in front of an outer surface of (22) the enclosure (14) and having an inclined orientation with respect to the outer surface.

A passive armour (10) according to the invention can be used for the protection of an enclosure selected from the group consisting of land vehicles such as battle tanks, armoured personnel carriers and armoured fighting vehicle; static structures and aircrafts.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A passive armour for protection against shaped charges, the passive armour comprising:

a rigid enclosure filled with hollow microspheres made of a material having a density greater than 7 g/cm$^3$ and hardness at least equal to 800 Vickers.

2. A passive armour as claimed in claim 1, wherein the microspheres are embedded in a matrix.

3. A passive armour as claimed in claim 2, wherein the matrix is made of a material selected from the group consisting of an organic material and a metallic material.

4. A passive armour as claimed in claim 1, wherein the density of the microspheres is greater than 10 g/cm$^3$.

5. A passive armour as claimed in claim 1, wherein the hardness of the microspheres ranges from 2400 Vickers to 3200 Vickers.

6. A passive armour as claimed in claim 1, wherein the microspheres are made of carbide.

7. A passive armour as claimed in claim 6, wherein said carbide is selected from the group consisting of WC, TiC, NbC, SiC and BC.

8. A passive armour as claimed in claim 7, wherein the microspheres are made of WC.

9. A passive armour as claimed in claim 1, wherein the hollow microspheres have a diameter ranging from 10 $\mu$m to 500 $\mu$m.

10. A passive armour as claimed in claim 2, wherein the matrix is made of a metallic material.

11. A passive armour as claimed in claim 10, wherein the metallic material of the matrix is selected from the group consisting of military steels, high-strength low-alloy steels, nitinol, tool steels and martensitic steels with a high residual austenite content.

12. A passive armour as claimed in claim 11, wherein the microspheres occupy in volume at least 20% of the total volume of the enclosure.

13. A passive armour as claimed in claim 12, further comprising:

triggering means for triggering an explosion of a shaped charge approaching the passive armour.

14. A passive armour as claimed in claim 13, wherein the triggering means comprise means for deviating a jet from the shaped charge.

15. A passive armour as claimed in claim 14 wherein the triggering means comprise a series of plates mounted in front of an outer surface of the enclosure and having an inclined orientation with respect to said outer surface.

16. A passive armour as claimed in claim 1 being integral to a basic armour element.

17. A passive armour as claimed in claim 1 being an add-on to a basic armour plate.

18. A passive armour for protection against shaped charges, the passive armour comprising:

a body made of a metallic matrix; and a plurality of hollow microspheres of tungsten carbide embedded in the matrix, the microspheres having a diameter ranging from 10 $\mu$m to 500 $\mu$m and occupying in volume at least 20% of the total volume of the body.

19. Use of a passive armour as defined in claim 18, for the protection of an enclosure selected from the group consisting of land vehicles, static structures and aircrafts.

20. Use according to claim 19, wherein the land vehicles are selected from the group consisting of battle tanks, armoured personnel carriers, armoured fighting vehicles.

21. A passive armour as claimed in claim 1, wherein the hollow microspheres have a diameter ranging from 10 $\mu$m to 500 $\mu$m.

22. A passive armour as claimed in claim 21, wherein the microspheres occupy in volume at least 20% of the total volume of the enclosure.

23. A passive armour as claimed in claim 21, wherein said enclosure contains hollow microsphere all of substantially the same diameter.

* * * * *